US005984558A

United States Patent [19]

Diep

[11] Patent Number: 5,984,558

[45] Date of Patent: Nov. 16, 1999

[54] COMBINATION BOOKMARK AND HIGHLIGHTER

[76] Inventor: Michael T. Diep, 1075 Bellevue Way NE. Ste 433, Bellevue, Wash. 98004

[21] Appl. No.: 08/892,496

[22] Filed: Jul. 14, 1997

[51] Int. Cl.[6] ..... B43K 29/00

[52] U.S. Cl. ..... 401/195; 401/52; 24/11 CC

[58] Field of Search ..... 401/195, 52; 281/30, 281/42; 24/11 CC, 10 R, 11 PP; D19/34; 116/234, 238

[56] References Cited

U.S. PATENT DOCUMENTS 1,810,109 8/1931 McEnery ..... 401/52

1,974,667 1/1934 Solinger ..... 401/52

*Primary Examiner*—Henry J. Recla

*Assistant Examiner*—Huyen Le

*Attorney, Agent, or Firm*—Robert W. Jenny

[57] ABSTRACT

The top end of a writing instrument, such as a high lighter, is pivotally attached to one end of an elongated book mark. Adjustment of the angular relationship between the instrument and book mark is retained by friction, a detent or both. When the combination is in use as a book mark, the writing instrument is at a right angle to the book mark and lies along the end of the book.

1 Claim, 1 Drawing Sheet

COMBINATION BOOKMARK AND HIGHLIGHTER

BACKGROUND OF THE INVENTION

1. Field

The subject invention is in the fields of book marks and high lighters, i.e. pens which dispense transparent ink to accentuate portions of printed material without obliterating the material. It is also in the more particular field of devices and apparatuses which combine a book mark and a writing instrument such as a pen, pencil or high lighter.

2. Prior Art

Prior art believed to be typical is shown in the following U.S. Patents and one German patent.

| | | | |
|---|---|---|---|
| U.S. | 4,984,529<br>5,016,559<br>5,095,846 | German | 13735 |

The book mark of '846 is relatively complicated, having a mechanical clip and appendages extending from the clip both outside the back of the book and between pages of the book and with a writing utensil retainable in the appendage outside the book. With this book mark, having it attached to the book while the book is being used would be a significant inconvenience. On the other hand, if it is removed it would also be inconvenient to keep at hand as a loose item. Further, this book mark is considered to be relatively cumbersome and expensive to manufacture. It is presumed that the writing instrument could be a high lighter.

The apparatus of '529 is simple and straightforward. However, the writing instrument must be separated from the book mark during use and the book mark is usually removed from the book during use and high lighting of the book, making the book mark an inconvenient loose piece, vulnerable to misplacement and/or loss.

The book mark of '559 is similar to the apparatus of '529, also being simple, straightforward and vulnerable to the misplacement and/or loss of the book mark while the writing instrument and book are in use.

The German invention is also simple and straightforward and has no parts vulnerable to misplacement and/or loss. It is a writing instrument, such as a high lighter, with permanently attached features which enable its use as a book mark when not in use as a writing instrument. Use of the invention as a book mark serves to keep the writing instrument handy for use whenever the book is to be read and high lighted. However, the features which enable use of the invention as a book mark do not securely attach the writing instrument to the book and retain it outside the book along the back of the book or on an edge of a cover, a condition which increases the chances of inadvertent dislodging of the invention when the book is being carried or is not in use.

In view of the above comments, the primary objective of the subject invention is to provide a combination book mark and writing instrument which is simple, has no loose parts and is minimally vulnerable to being dislodged from a book when the book is being carried or is otherwise not in use.

SUMMARY OF THE INVENTION

The subject invention is a combination book mark and writing instrument, particularly a high lighter. The book mark component is much like conventional book marks, being rectangular, flat and having a length several times its width. The writing instrument component is much like conventional writing instruments, particularly such instruments having lengths in a range of 3 to 7 inches. The two components are pivotally connected, one end of the book mark component being connected to the top end of the writing instrument component. The axis of the connection is normal to the broad surfaces of the book mark component. With this configuration, the writing instrument component is positioned along and in contact with an end of the book when the book mark component is in place in the book and the book is not being read or high lighted. The pivot connection may incorporate detent features to help assure that the writing instrument component remains along and close to an end of the book when the book is not in use and/or with the long axes of the components aligned when the writing instrument component is being used. In an alternate embodiment a stub component such as a socket is pivoted to the book mark component and the writing instrument and stub component are configured such that the top end of the writing instrument is detachably attachable to the stub component. In another embodiment the pivot connection is detachably attachable and no pivot pin is used.

The invention is described in more detail below with reference to the attached drawings.

DETAILED DESCRIPTION OF THE INVENTION

Figure 1:
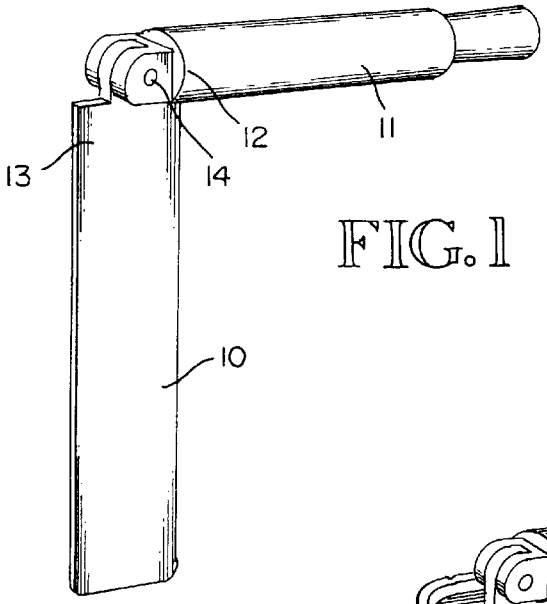
FIG. 1 is a general view of one embodiment of the subject invention.
Figure 2:
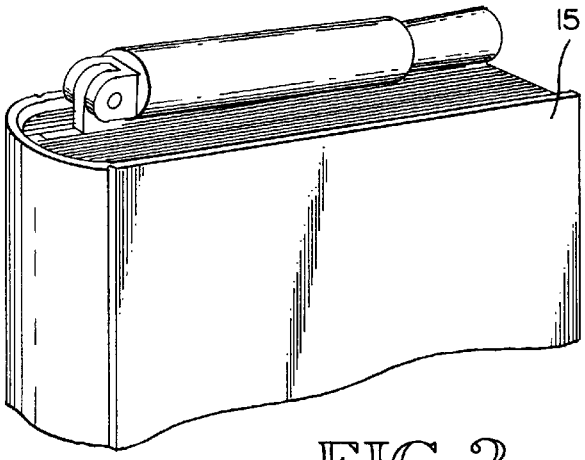
FIG. 2 illustrates the embodiment of FIG. 1 in a book which is not in use.
Figure 3:
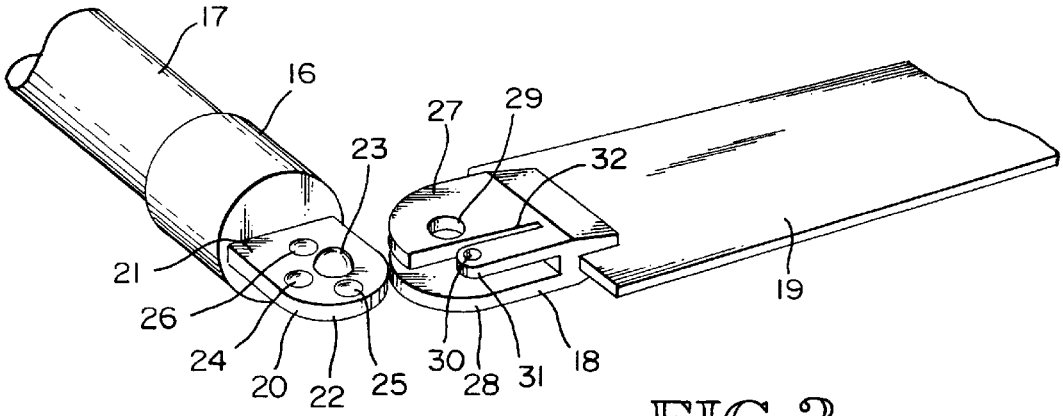
FIG. 3 is an exploded partly cut away view of a pivot connection which is detachably attachable and detented.

The subject invention is a combination book mark and writing instrument. One embodiment of the invention is shown in FIG. 1. Book mark 10 is pivotally connected to writing instrument 11, in this embodiment a high lighting pen. End 12 of instrument 11 and top end 13 of book mark 10 are configured to form the pivoted connection and are connected by pin 14. FIG. 2 illustrates the embodiment of FIG. 1 in a book 15 which is not in use. In an alternate embodiment fittings are attached to ends of the writing instrument and book mark. FIG. 3 illustrates one embodiment using such fittings. Fitting 16 is attached to writing instrument 17 and fitting 18 is attached to book mark 19. Tab 20 on fitting 16 has four partial spherical protrusions on at least one of sides 21 and 22, side 22 not showing in this view. Protrusion 23 is at the axis of the pivotal connection between the two fittings and protrusions 24, 25 and 26 are located at equal radial distances from protrusion 23 and are spaced 90° apart. Tab 20 fits closely between tabs 27 and 28 on fitting 18 with protrusion 23 fitting into hole 29 on tab 27 and one of protrusions 24, 25 or 26 engaging hole 30 in portion 31 of tab 27 which is partially separated from tab 27 by slot 32 to form a leaf spring. Engagement of protrusions 24, 25 and 26 in hole 30 provides detent action for the pivoting between the writing instrument and book mark. The detent action holds the two components with their long axes aligned or at 900 to each other in either of two positions.

The pivoted connection can also be implemented with a friction producing feature such that the angular relationship of the two components tends to be fixed.

In preferred usage of the subject invention, when the writing instrument component is being used the long axes of the two components are aligned and, when use of the writing instrument is complete, the book mark is inserted in the book, the book is closed and the writing instrument component is folded so that it lies along the end of the book.

It is considered to be understandable from the above description that the subject invention meets its objectives. It provides a combination book mark and writing instrument which is simple, has no loose parts and is minimally vulnerable to being dislodged from a book when the book is being carried or is otherwise not in use.

It is also considered to be understood that while certain embodiments of the invention are described herein, other embodiments and modifications of those described are possible within the scope of the invention which is limited only by the attached claims.

I claim:

1. A combination book mark and writing instrument comprising:

a book mark component, a writing instrument component, and a pivot connection means, said book mark being elongated and having a first end, said writing instrument having a top end, said first end of said book mark component and said top end of said writing instrument component being pivotally connected by said pivot connection means such that said book mark component and said writing instrument component are pivotally connected wherein said pivot connection means comprises means for inhibiting relative angular motions between said components.

* * * * *